US005639420A

United States Patent [19]

Sander et al.

[11] Patent Number: 5,639,420

[45] Date of Patent: Jun. 17, 1997

[54] METHOD OF MANUFACTURING COMPACTED GRAPHITE CAST IRON

[75] Inventors: Bertil Nils Gunnar Sander, Nygård; Berndt Ingar Resne Gyllensten, Skövde; Lars-Eric Thorsten Uhr, Skövde; Per Inge Dahlöf, Skövde; Olov Skärgård, Skövde; Sven-Eric Dahlberg, Skövde, all of Sweden

[73] Assignee: AB Volvo, Gothenburg, Sweden

[21] Appl. No.: 952,740

[22] PCT Filed: May 27, 1991

[86] PCT No.: PCT/SE91/00374

§ 371 Date: Jan. 28, 1993

§ 102(e) Date: Jan. 28, 1993

[87] PCT Pub. No.: WO91/19012

PCT Pub. Date: Dec. 12, 1991

[30] Foreign Application Priority Data

May 28, 1990 [SE] Sweden ..... 9001894

[51] Int. Cl.[6] ..... C21C 1/10

[52] U.S. Cl. ..... 420/19; 420/20; 420/29; 420/30

[58] Field of Search ..... 420/19, 20, 29, 420/30

[56] References Cited

U.S. PATENT DOCUMENTS 4,298,377 11/1981 Szekely ..... 420/29

FOREIGN PATENT DOCUMENTS 659924 1/1963 Canada ..... 420/19
101708 8/1979 Japan ..... 420/19
406264128 9/1994 Japan ..... 420/20

*Primary Examiner*—Deborah Yee
*Attorney, Agent, or Firm*—Cushman Darby & Cushman IP Group of Pillsbury Madison & Sutro LLP

[57] ABSTRACT

A method of manufacturing compacted graphite cast iron, in which graphite modifying alloying agents, in the form of a so-called treatment alloy, are added to low-sulphurous molten cast iron. The treatment alloy is added to the molten iron by being sprayed into a jet of the molten iron as the latter is being discharged from a casting furnace. A dosed amount of treated iron is maintained for a predetermined period of time inside a casting box for homogenization and slag flotation, whereupon it is poured into a casting mold.

8 Claims, 1 Drawing Sheet

METHOD OF MANUFACTURING COMPACTED GRAPHITE CAST IRON

BACKGROUND OF THE INVENTION

The subject invention concerns a method of manufacturing compacted graphite cast iron/vermicular cast iron by adding graphite-modifying alloying agents, a so-called treatment alloy, to low-sulphurous molten cast iron.

Several methods are used today to manufacture compacted graphite cast iron. The most well-known method is the ladle treatment, according to which treatment an alloy, usually consisting of FeSiMgRECa, wherein RE refers to rare earth metals, is reacted with the iron. Several varieties of ladle treatments exist, such as the sandwich, the tundish cover, and other varieties. However, all varieties suffer from a number of deficiencies, common to them all. One is the extensive manual handling that often is required, such as slagging and tapping operations. Another drawback is the considerable length of time between the treatment and the casting operations that the ladle method in its different varieties requires, in addition to which the length of this time as also that of the casting often vary. This is a serious drawback since, preferably, compacted graphite cast iron should be cast after a holding time that should be constant and not exceed 5 minutes following the treatment. The reason therefor is the unstable condition of the molten iron during the treatment. Immediately following the treatment, the Mg and RE elements therein start to fade out, i.e. to evaporate and to form sulphide and oxide at different paces. Among other things, this makes it considerably more difficult to maintain the appropriate temperature in the casting oven, and as a results thereof, handle the iron rationally in a continuous-casting foundry. The contents of Mg and RE must be maintained within very narrow intervals, since the structural variations allowed in the castings are very limited.

In order to achieve correct structure and quality in the castings the fade-out during the temperature maintenance period, i.e. the Mg and RE contents and the nucleating condition, must be continuously measured and the conditions of the treatment be corrected. No reliable and productional technology known to the present inventors exists, either for measuring or correcting these parameters. This obviously very difficult problem of process control is one of the main reasons for the lack of success of compacted graphite iron as a constructional material, despite the excellent properties that this material possesses as such.

Another method which is based on a well-known principle is the in-mold treatment. In accordance with this method, MgRE is added to the iron by placing a treatment alloy in a reaction chamber incorporated in the casting system of the mold. When the molten iron flows over the treatment alloy in contact therewith, it picks up MgRE in amounts that are dependent on several factors, among them the flow of the iron, the area of the reaction chamber, the temperature of the iron, and the size of the granules of the alloy.

This method is advantageous, inasmuch as only the temperature of the untreated east iron need to be maintained at the correct level. Consequently, the problem of fade-out is eliminated, since the treatment lasts for a few seconds only, prior to the molten cast iron reaching the mold cavity.

However, this method requires that the casting system, the area of the reaction chamber, and other parameters be carefully designed and calculated in all details in order to ensure that the castings be entirely free of inclusions, reaction agents and undecomposed treatment alloy material, and thus that a perfect treatment result be obtained. Also, the reaction chamber encroaches on the space inside the mold and diminishes the casting yield, in that some molten iron remains in the chamber.

SUMMARY OF THE INVENTION

The subject invention provides a method based on a new principle of adding treatment alloy material to low-sulphurous molten cast iron in order to produce compacted graphite cast iron.

BRIEF DESCRIPTION OF THE DRAWING

The method in accordance with the invention will be described in closer detail in the following with reference to the accompanying drawing figure, FIG. 1 which in a lateral view illustrates a casting mold and in a vertical sectional view a bottom-dump casting box positioned on top of the mold and equipped With a device for supply of treatment alloy material.

DETAILED DESCRIPTION

Figure 1:
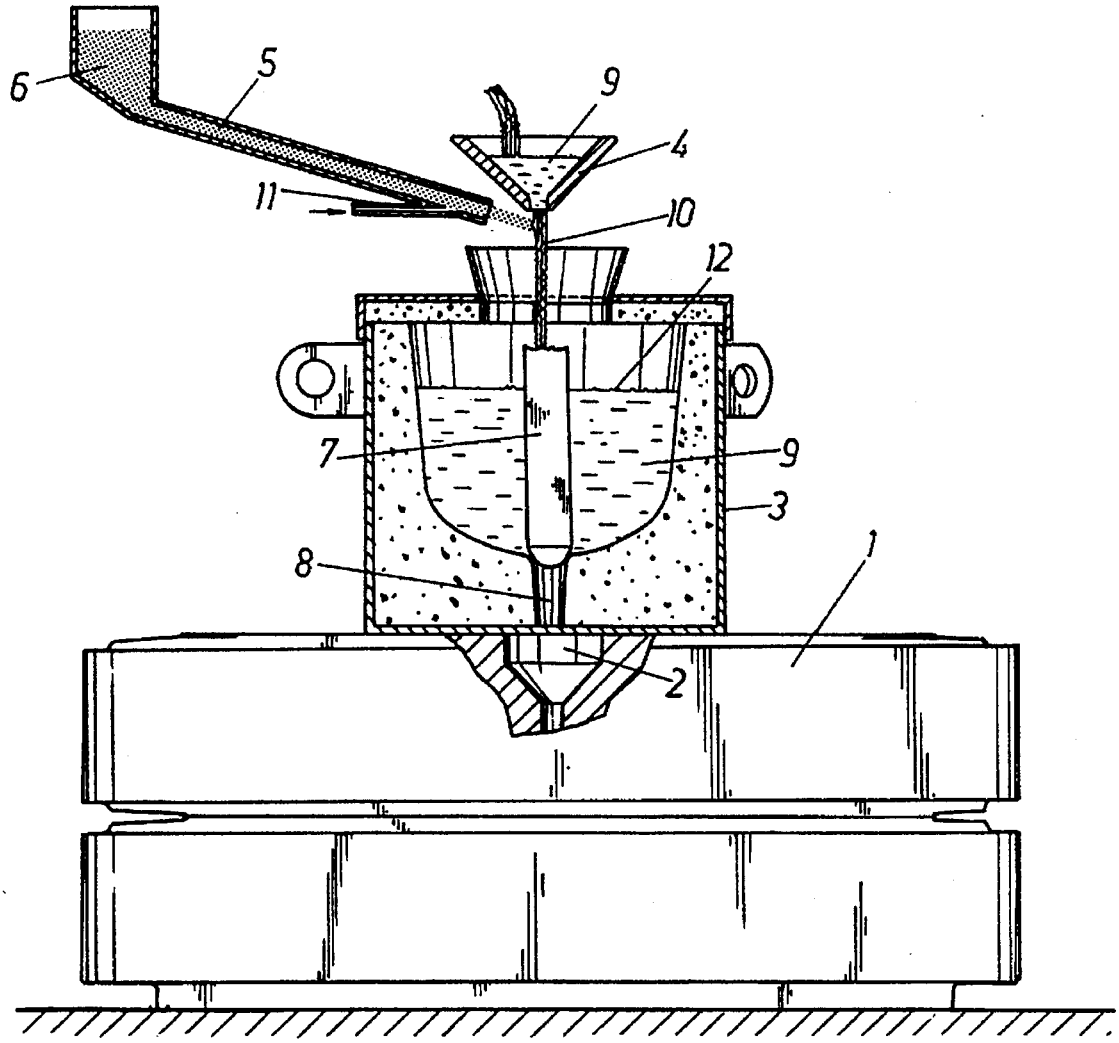

In order to describe the method in accordance with the invention the drawing figure illustrates an essentially schematically represented casting mold 1, one part of which is illustrated in a broken view in order to show the casting bowl 2 of the mold. Centrally above the casting bowl on top of the mold 1, a casting box 3 is positioned. Advantageously, it could be an integral part of the upper portion of the mold. A bottom-dump ladle suspended above the mold has the same function as the box 3. A funnel 4 is located above the casting box 3, as is also a device 5 arranged to supply treatment alloy material 6. A stopper 7 closes the bottom drainage channel 8 in the casting box 3.

From a casting furnace or ladle, not shown, metered quantities of molten iron 9 are made to flow down into the casting box 3 via the funnel 4. In accordance with the method of the invention, treatment alloy material 6 is sprayed into the Jet 10 of molten iron as the latter is discharged into the casting box 3. The function of the funnel 4 is to control the flow and position of the jet 10 so as to ensure a stable pattern of impact of the spray of treatment alloy material, as well as a constant relationship between the the rates of flow of iron and alloy materials. The position and flow of the molten iron jet 10 may be kept stable in some other way, for instance by using a stopper-regulated casting furnace, in which case the funnel 4 is no longer needed.

The treatment alloy material 6 preferably consists of a powder having a granular size of 0.1–1.0 mm. Through a branch pipe 11 in the powder supply channel, pressurized air or other gas having a pressure of 2–3 bars is pumped into the powder so as to act as a propellent gas, whereby the powder will be sprayed into the jet 10 of molten iron through an ejection effect.

A quantity of molten iron 9 metered for the needs of a particular casting is retained inside the casting box 3 for a period of between 5 and 40 seconds. However, the decomposition of the treatment alloy material 6 takes place already in the Jet 10 of molten iron. Subsequently, homogenization of the added alloy elements and flotation of the reaction products (slag) occur inside the casting box 3. After expiration of the residence time, the bottom drainage channel 8 is opened by raising the stopper 7 and the molten iron 9 is allowed to flow down into the mold 1. Any slag products in the iron collect in the material that is the last to be cast, and therefore it is prevented from entering into the castings.

The casting box 3 may be designed for use once only, or for repeated use. When designed to be used only once, it is formed from a molding material, such as green sand, contained in an external enclosure of heavy plate. When designed for repeated use, the casting box 3 is formed, e.g. with a refractory lining and with a graphite stopper. During the residence period of 5–40 seconds, the bottom drainage channel 8 of the casting box 3 seals the latter from the casting bowl 2.

The quantity of iron 9 inside the casting box 3 may be metered in various ways, for instance by using a system based on scales, or on visual, optical or inductive level readings.

The Jet 10 of the molten iron and the surface 12 of the bath of the molten iron 9 are protected from oxygen by means of an inert atmosphere or by means of a reducing LP-gas flame.

The method is in many respects very advantageous in comparison with the prior-methods described initially. For instance, it is possible to maintain the molten iron 9 at the correct temperature level indefinitely inside a casting furnace without having to deal with fade-out effects and slag build-up. In addition, the method easily lends itself to reproduction because of the absence of the fade-out phenomenon that occurs in the conventional ladle method because of the length thereof, and also because of the easy measurement and adjustment of the control parameters, such as the sulphur contents of the iron, the weight of the iron, the weight of the alloy, and the residence times. An advantage of decisive importance is the insensitivity that the treatment exhibits immediately before the casting operation to variations in the nucleating condition of the basic iron material and to any inoculation. Yet another advantage is that the method requires no inoculation except the one ocurring as a result of the treatment.

The method in accordance with the invention is not limited to the features described and illustrated but may be varied in may ways within the scope of the invention. The majority of the most easily decomposable and commercially available treatment alloys for compacted graphite cast iron may be used. Alternatively, automated equipment designed for jet inoculation may be used to meter and blow the treatment alloy 6 into the jet 10 of molten iron.

We claim:

1. A method for manufacturing compacted graphite cast iron, comprising the steps of:

(a) spraying a treatment alloy comprising graphite-modifying alloying agents, into a jet of molten low-sulfurous cast iron while discharging an amount of the molten low-sulfurous cast iron from a casting furnace or ladle, and thereby treating the amount molten low-sulfurous cast iron to provide a dose of treated molten iron for use in a casting process;

(b) introducing the dose of treated molten iron into a casting box and mounting it there for a residence period, during which the dose treated molten iron undergoes homogenization and slag flotation; and (c) thereafter pouring said dose of treated molten iron into a casting mold.

2. The method of claim 1, wherein: said residence period is from 5 to 40 seconds.

3. The method of claim 1, wherein:

said treatment alloy, when sprayed in step (a), is in the form of a powder having a grain size of from 0.1 to 1.0 mm.

4. The method of claim 1, wherein:

said treatment alloy, when sprayed in step (a), is carried in a stream of propellant gas.

5. The method of claim 4, wherein:

said propellant gas is air.

6. The method of claim 1, wherein:

in step (c), said pouring is practiced by opening a dump channel in said casting box by vertically moving a stopper disposed in closing relation to said dump channel.

7. The method of claim 1, wherein:

while being maintained in said casting box and being poured therefrom, said dose of treated molten iron exists in said casting box as a bath having a surface; and said method further comprises:

protecting said jet, and said surface of said bath with a reducing flame or an inert atmosphere.

8. The method of claim 1, further comprising:

prior to conducting step (a), determining the amount of treated molten cast iron needed for introduction into said casting mold in step (c) for filling said casting mold sufficiently to produce a desired casting; and in step (a), causing said dose to be substantially equivalent in volume to said amount.

* * * * *